US007303149B1

(12) United States Patent
Huang

(10) Patent No.: US 7,303,149 B1
(45) Date of Patent: Dec. 4, 2007

(54) AUTOMATIC SPRAY GUN

(76) Inventor: Jung-Kun Huang, P.O. Box 697, Fongyuan City 420, Taichung County (TW) 420

( * ) Notice: Subject to any disclaimer, the term of this patent is extended or adjusted under 35 U.S.C. 154(b) by 0 days.

(21) Appl. No.: 11/723,444

(22) Filed: Mar. 20, 2007

(51) Int. Cl.
*B05B 9/04* (2006.01)

(52) U.S. Cl. ..... 239/332; 239/351; 239/355; 239/375; 239/302; 239/290; 239/296; 239/291; 239/292

(58) Field of Classification Search ..... 239/290, 239/291, 292, 298, 296, 301, 302, 315, 316, 239/333, 351, 355, 375
See application file for complete search history.

(56) References Cited

U.S. PATENT DOCUMENTS 1,881,570 A * 10/1932 Hermann ..... 239/290
4,693,423 A * 9/1987 Roe et al. ..... 239/332

* cited by examiner

*Primary Examiner*—Dinh Q. Nguyen

(57) ABSTRACT

An automatic spray gun includes a cylinder for disposing a motor and a turbine therein and sealed by a sealing cap and an outer cap, a sleeve perpendicularly integrated with lower periphery of the cylinder, a container cap integrated with an under side of the sleeve for covering a paint container, a Y-shaped pressing means suspended from an axial rod on a top of the sleeve, a nozzle with a group of fittings engaged in the sleeve, a fist half handle integrated to the bottom of the cylinder and combined with a second half handle by screws, a tube, a hair switch and a number of electric wires disposed in the handle for connection of electric power to the motor through the switch which controls the rotation of the motor.

2 Claims, 8 Drawing Sheets

(A)

(B)

AUTOMATIC SPRAY GUN

BACKGROUND OF THE INVENTION

The present invention relates to spray guns and more particularly to an automatic spray gun in which the cylinder has an inner housing integrated with an outer housing and the sleeve enabling to stably increase the pressure and effectively output the atomizing.

A spray gun provides the air by a motor and a turbine and utilizes the siphonic effect to spray the atomized paint to a working object. A spray gun Pub. No. US2005/0269425 A1 has a nozzle through an axial rotation fixed to a rod in a sleeve which accommodates a atomizing nozzle and the air current is created by a turbine. The principal feature the turbine and the motor and the sleeve which loads an atomizing nozzle are coaxial or mostly coaxial arrangement such that the air current follows a straight line or almost straight line through the atomizing nozzle of the sleeve. Furthermore the turbine has a muffler.

Although, this arrangement aims to prevent to air current becoming weakness for strengthening the atomizing paint and keeping it effective to spray out of the nozzle. But it can't solve that the air current more and more week up due to that:

1) the outer housing of the sleeve, motor and the turbine is separated and is taken apart (as shown FIG. 4 of this case) the air current from the turbine flowing to the sleeve though almost straight but not sealed tightly such that the pressure is not stable, but decrease the air current flowing strength;

2) the muffler adopts spiral orbit, it is disturbed by the air current and increase the load of the motor;

3) the turbine and motor and the sleeve loading a nozzle almost coaxial increase the length of the spray gun in relation to the motor, it volume seams larger;

4) because of the housing of turbine, motor and sleeve is of taken apart that increases the steps to assemble so as to increase the cost.

SUMMARY OF THE PRESENT INVENTION

The present invention has a main object to provide an automatic spray gun which adapt a boost cylinder by which the air current can effectively output without that the air current follows a straight line.

Accordingly, the automatic spray gun of the present invention comprises generally:

a cylinder which is an air frame including an inner housing integrated with an outer housing, a sleeve, a cup for a paint container ad a half handle, a seal covering the inner housing, and an outer cover covering the outer housing;

the sleeve receiving the air current from the cylinder and having inner fittings and a nozzle at outer end for spraying the atomized paint, the handle being combined with two halves having press member for touching a hair switch which is provided to actuate the motor and the turbine;

thereby the integrated cylinder and sleeve forms a sealed super charge type air frame to obtain that the effective air current input into the sleeve.

The present invention will become more fully understood by reference to the following detailed description thereof when read in conjunction with the attached drawings.

DETAILED DESCRIPTION OF THE PREFERRED EMBODIMENT

With reference to the drawings and initiated from FIGS. 1 to 4, the automatic spray gun of the present invention comprises generally a cylinder 10, a sleeve 20, a handle 30 and a paint container 40.

Figure 6:
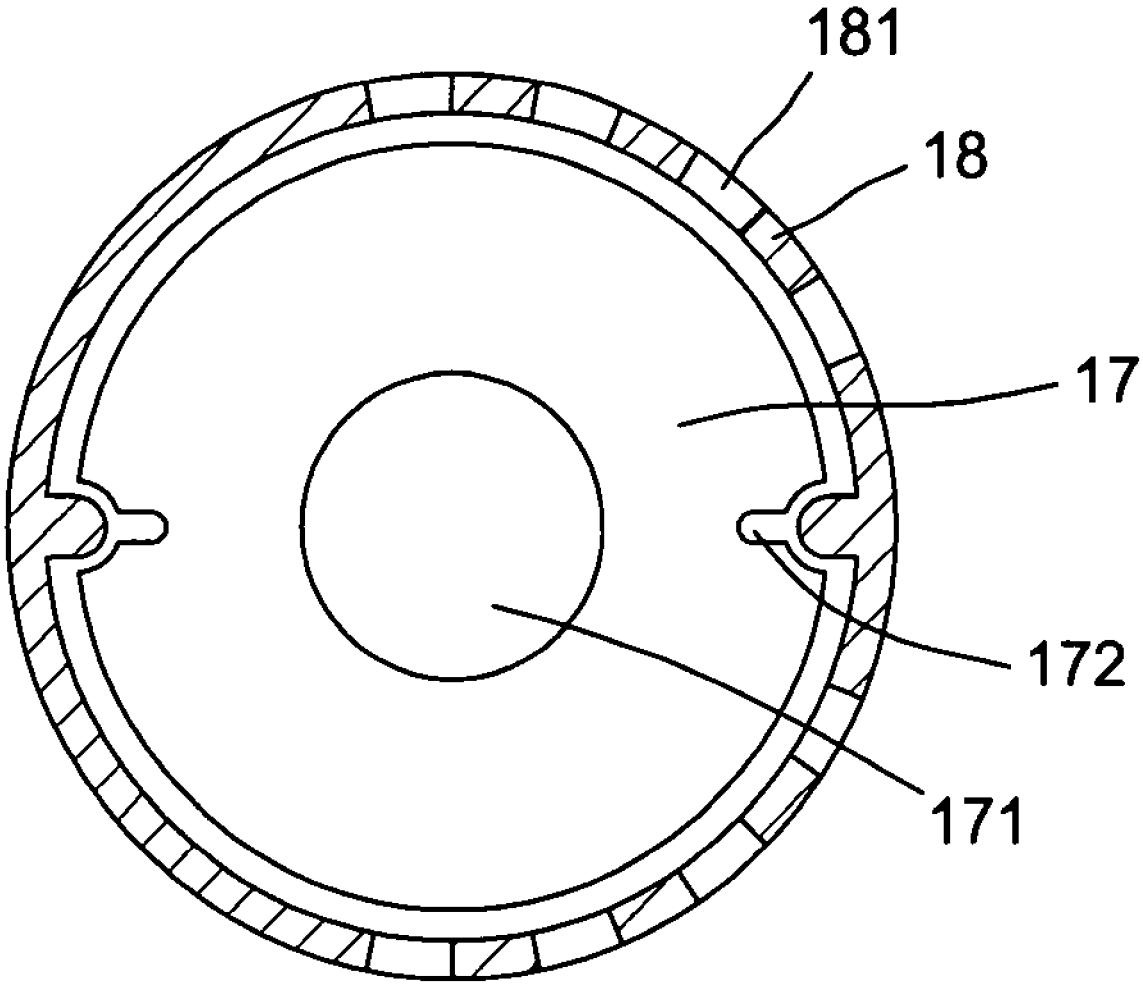
FIG. 6 is a sectional view of the seal and the outer cover.

The cylinder 10 has an inner housing 11 integrated with an outer housing 12 and connected with one another by a plurality of ribs 13, the inner housing 11 is of an air frame 14 into which is a motor 15 and a turbine 16 operated by the motor 15, a sealing cap 17 covering the top of the inner housing 11 to seal off the air frame 14, the sealing cap 17 is made of the plastic, the metal or a hard sponge which are sound absorption and dirt collection and having a central bore and a pair of slits on opposing peripheries, an outer cap 18 covering the outer housing having a plurality of air slots 181 spacedly formed in a periphery for the intake of the fresh air and a pair of through holes 182 symmetrically formed in the top engage with the slits 172 of the sealing cap 17 and the screw holes 131 in a pair of opposing ribs 13 of the cylinder 10 and fastened by a pair of screws 183 (as shown in FIG. 6).

Figure 1:
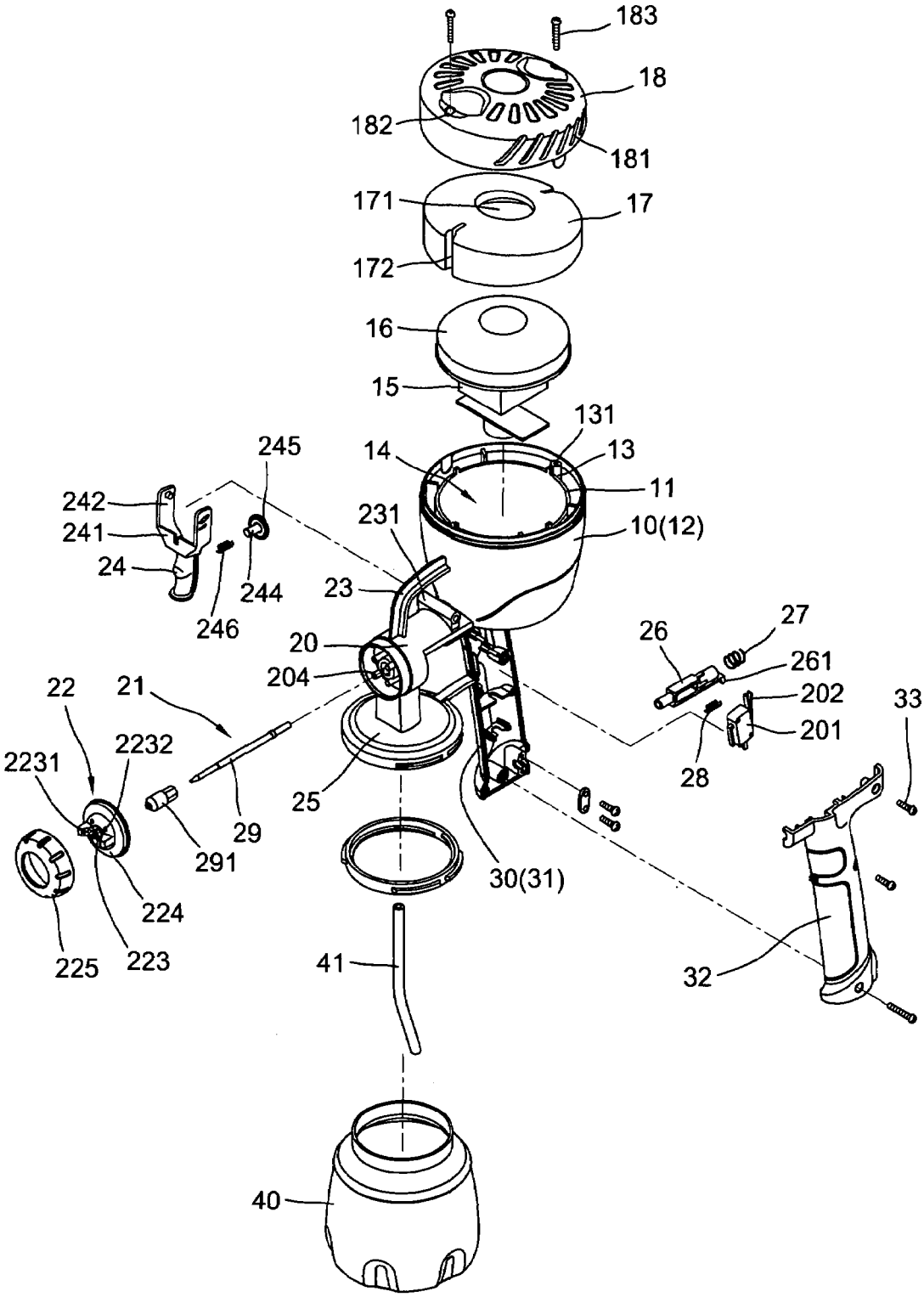
FIG. 1 is an exploded perspective view of the preferred embodiment of the automatic spray gun of the present invention.
Figure 2:
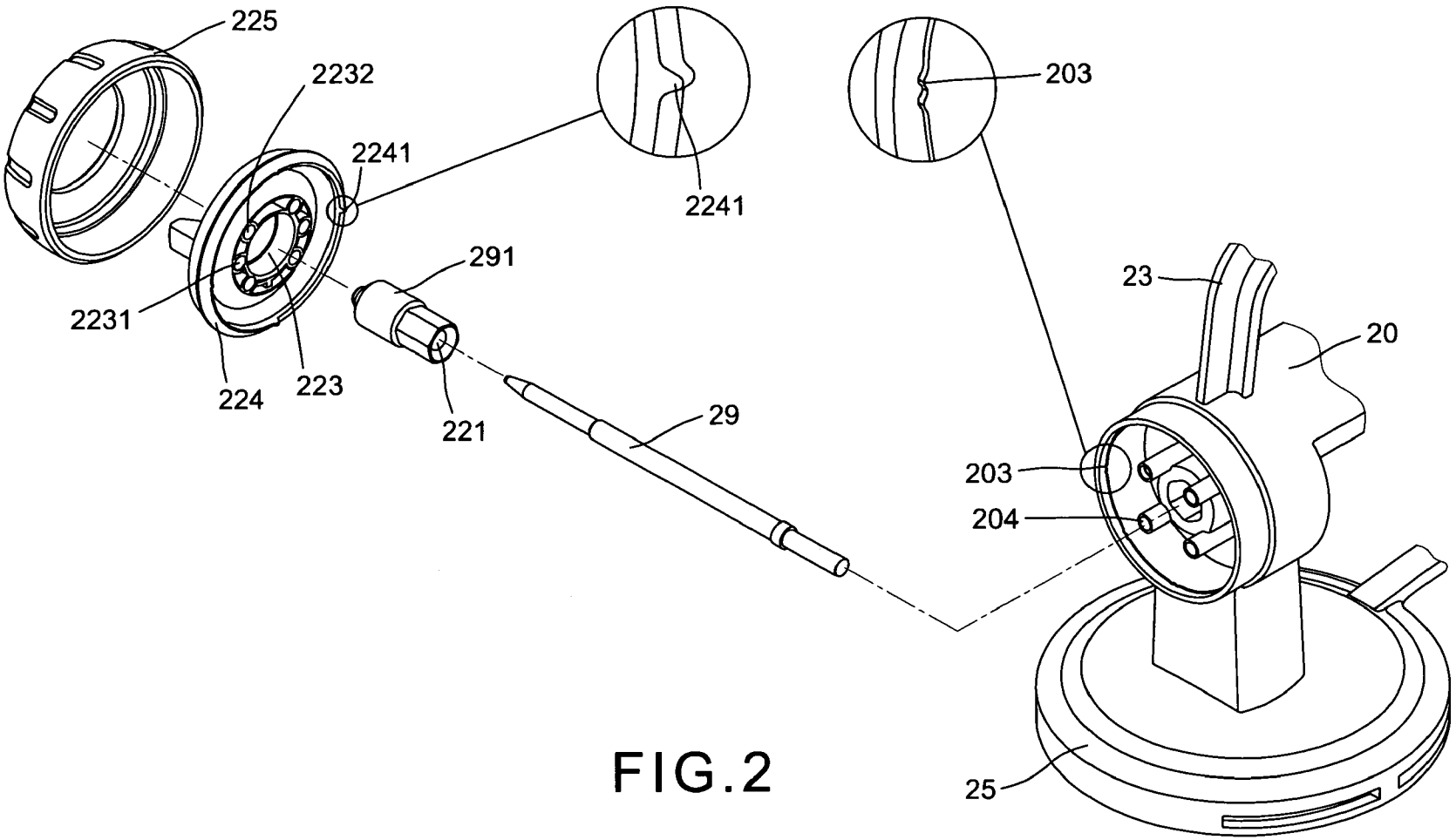
FIG. 2 is an exploded perspective view and partially enlarged image to show the sittings of the nozzle.
Figure 3:
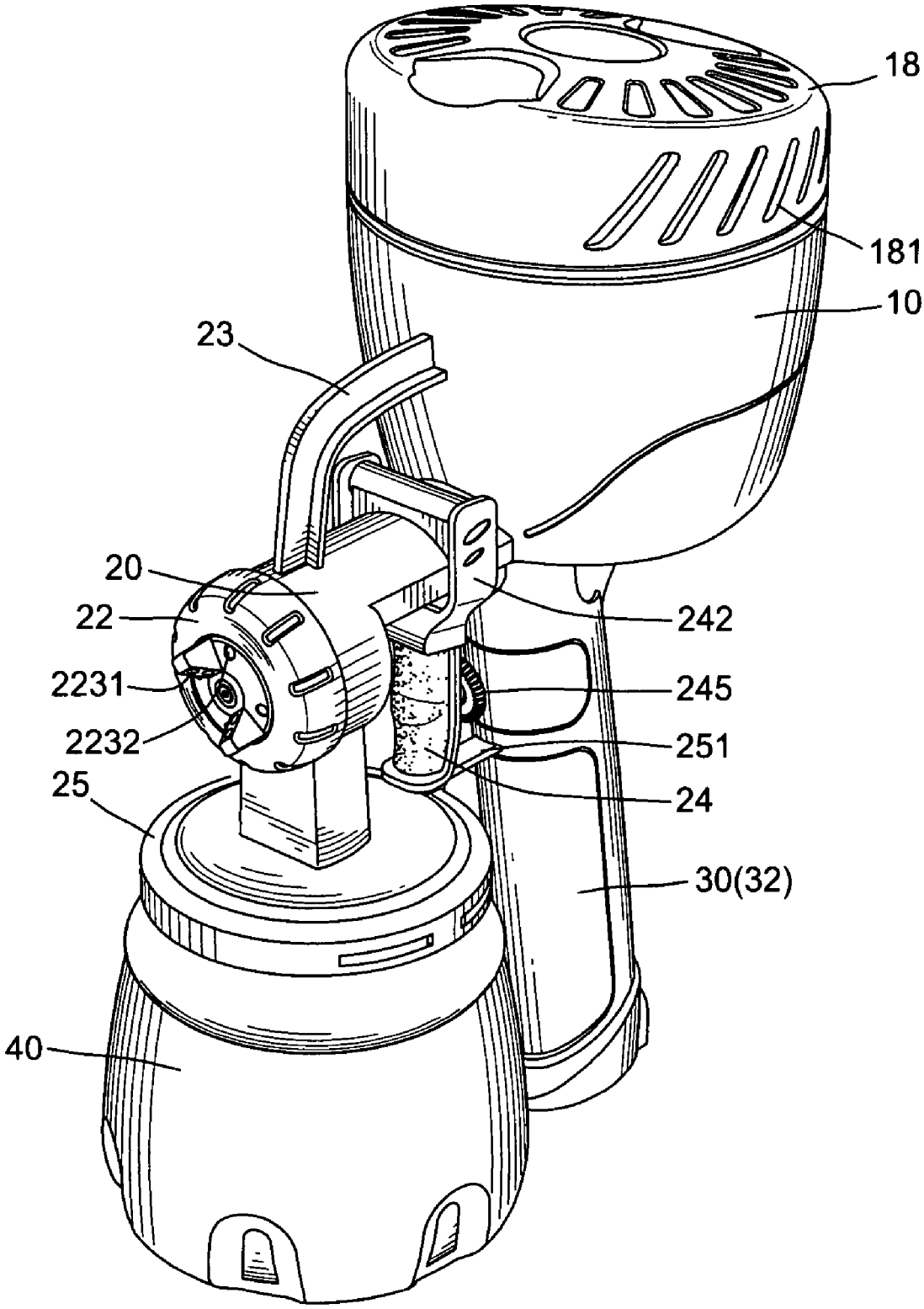
FIG. 3 is a perspective view to show the assembly of the automatic spray gun of the present invention.
Figure 4:
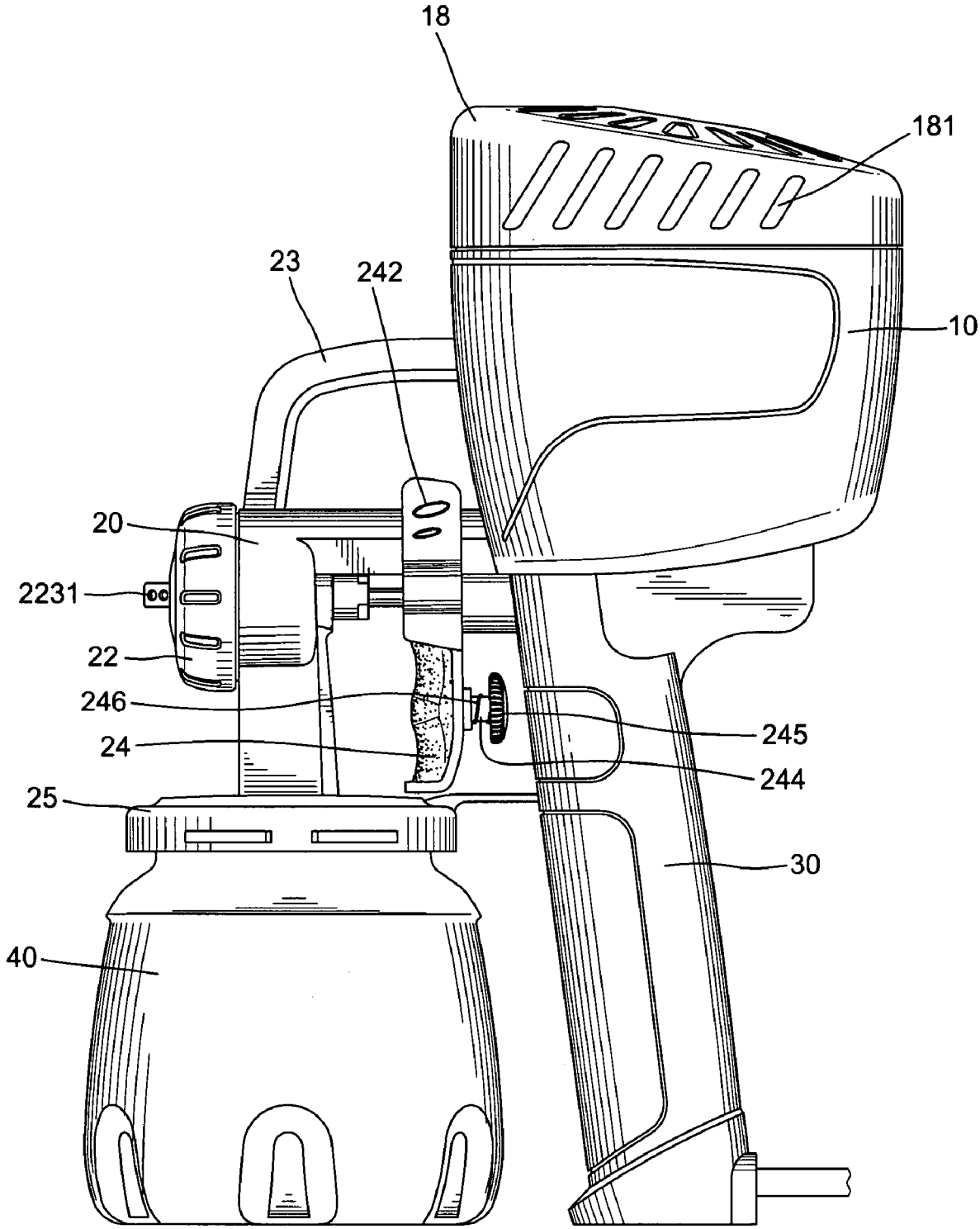
FIG. 4 is a perspective view of FIG. 3 looking from a lateral side.
Figure 5:
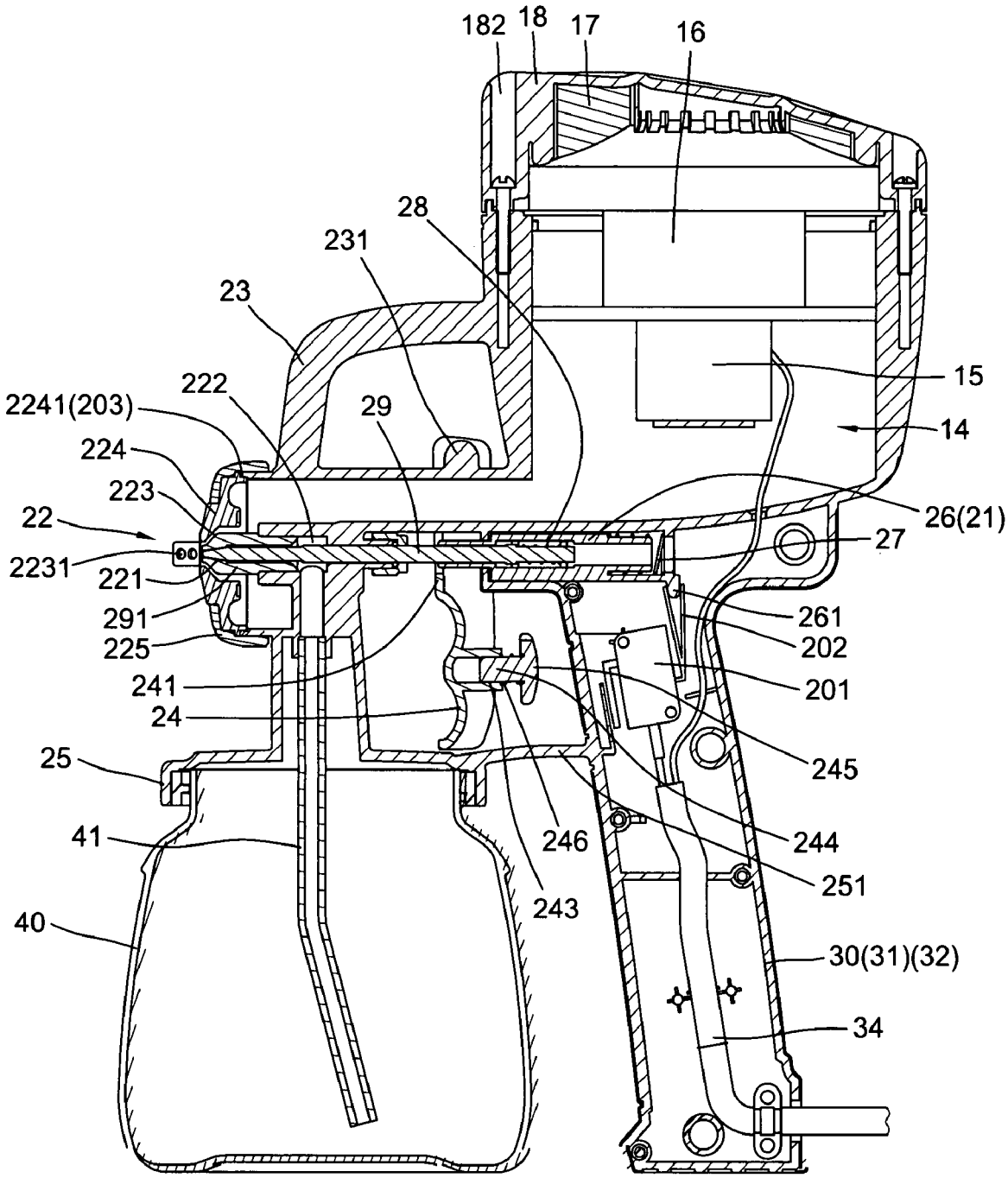
FIG. 5 is a sectional view of FIG. 4.

The sleeve 20 is perpendicular or similarly perpendicular to the cylinder 10 having fittings 21 inside, an atomizing nozzle outside, an inverse L-shaped link 23 and an axial tube 231 on a top, the inverse L-shaped link integrates both with the cylinder 10 and sleeve 20 where the axial tube solely integrates with the sleeve 20, the axial tube 231 axially connected a Y-shaped pressing means which is oscillatory on the axial tube 231 having a hinder 241 and a U-shaped plate 242 on the top axially connected to the axial tube 231, and the hinder 241 is provided to push the fittings 21 inside the sleeve 20, a container cap 25 under the sleeve 20 and integrated with the sleeve 20 for assembling a paint container 40, the container cap 25 is integrated with the half handle 31 through a link 251 the back side of the pressing means 24 having a screw hole 243 (as shown in FIG. 5) which is provided to screw in a bolt 244 having a swivel button at outer end biased by a small spring 246, the moving distance of the pressing means 24 is decided by the depth of the bolt 244, the depth of the bolt 244 also controlling the spraying amount of the paint.

Although the fittings 21 is of generally art, here is worthy to mention. The fittings 21 includes a tube 26 positioned in the top of the handle 30 biased by an outer spring and so that tube 26 is anchored and to be displaced upon outer tensions, a needle 29 having inner end inserted into the tube 26 and biased by an inner spring 28, the outer end inserted into a nozzle through an opening 221 of a tubular head 291, the inner end of the tube 26 has a touching means 261 to touch two metal tongues 202 of a hair switch 201 which is to actuate the motor 15 and the turbine 16 to rotate, the nozzle 22 including a swivel inner plate 224, a swivel cap 225 and the tubular head 291 screwed to the swivel inner plate 224, a central air canal 223 surrounded by a plurality of small air canals 2231 and 2232, a plurality of protrusions 2241 on the periphery engageable with the concaves 203 of the sleeve 20, this arrangement aims to distinguish that whether or not, the rotation angle of the swivel inner plate 224 is correct, inside the sleeve 20 is a number of anti-fouling pipes 204 which is provided to block in the small air canals 2231 or 2232 for changing air directions of the small air canal 2231 and 2232 perpendicular or horizontal or changing the angle, the needle is sliding forward or backward to block or to open the opening 221, inside the sleeve 20, there is a liquid flowing canal 222 which is a passage of the liquidized paint from a container 40 through a hose 41 by utilizing the siphonic effect. Finally, close the other half of the handle 32 to the integrated half handle 31 after the arrangement of a number of the electric wires 34 and the hair switch 201 into the handle 30.

Figure 7:
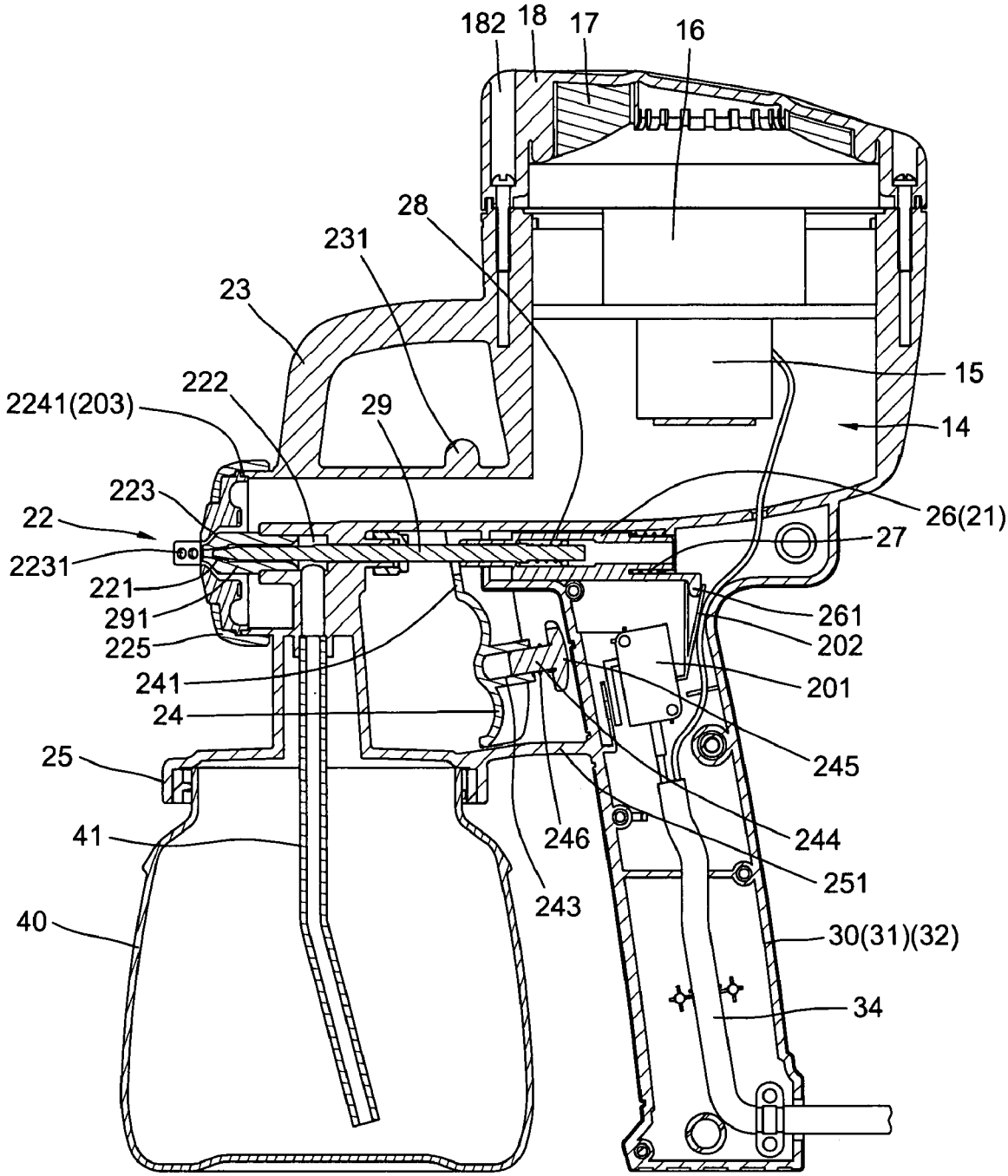
FIG. 7 is a sectional view to show the position of a needle.

In operation (as shown in FIG. 7) as to operate other spray gun, first slightly press the pressing means 24 to touch the tube 26 which actuates the hair switch 201 that the motor 15 and the turbine 16 begin to work and the air flows to the sleeve 20. Press the pressing means 24 again, see the retreating distance to control the spray amount of the paint, when the needle 29 moving backward, the nozzle opening 221 is open to permit the air pressure to discharge out of the nozzle 22, the paint under siphonic effect through the hose 41 and the liquid flow canal 222 flew to the nozzle opening 221 and becoming atomized to spray out of the gun.

Figure 8:
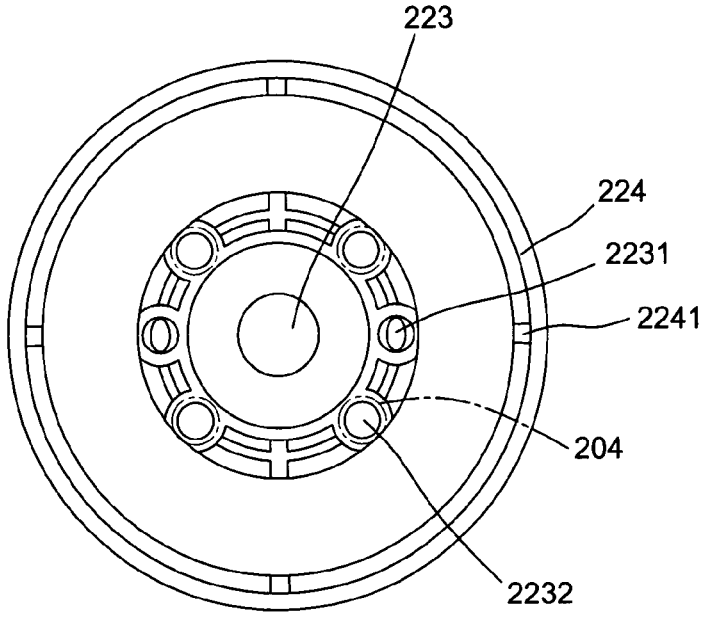
FIG. 8 is a plane view to show a swivel inner plate in operation (A)
Figure 9:
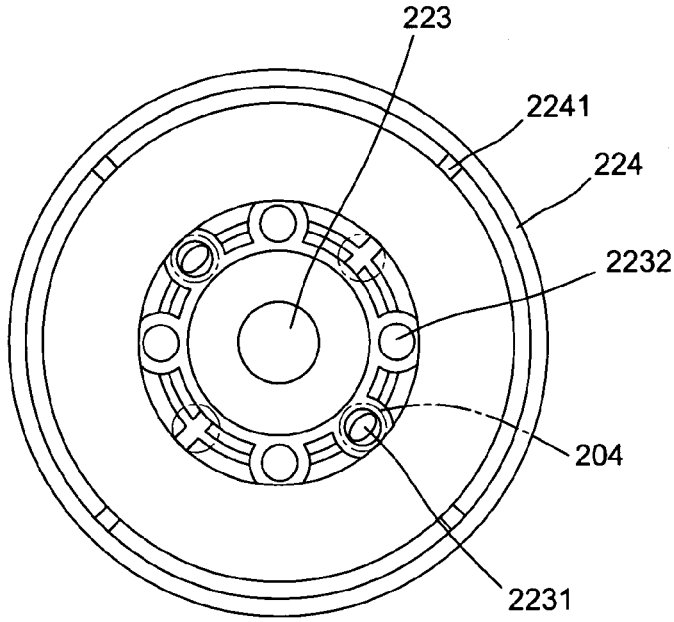
FIG. 9 is a plane view to show the swivel inner plate in operation (B).

Referring to FIG. 8, when rotate the swivel cap 225 to link up the swivel inner plate 224, the four anti-fouling pipe 204 will black in the four air flue 2232, only the other four air flue 2231 enable to pass the air, so the paint spraying out thin and flat, or otherwise blocks in the four air flue 2231, the paint is atomized to spray out or makes an angular change to varied the spraying state (as shown in FIG. 9).

So that the present invention not only improves the disadvantages for the prior art spray gun but has the following advantages:

a) the cylinder 10 is integrated with the sleeve 20 such that provides an easy assembly and less breakdown especially the easy disassembly of the part for cleansing up;

b) the air pressure in the air frame 14 will not leak out provides full air to the sleeve 20, the air pressure is gradually to ascend and effectively spraying out of the nozzle, it is unnecessary to make a straight line between the cylinder 10 and the sleeve 20;

c) the cylinder 10 make 90° angle of intersection with the sleeve 20 so its shape is similar to the common spray gun that easy to operated and simply to pack up;

d) the inner housing 11 and the outer housing 12 all having the function of soundproof, the noise of the motor 15 and the turbine 16 is blacked up by the housings 11 and 12 that needs not soundproof cloth for avoiding the increase of the volume of the machine, and e) the heat radiating area for motor 15 is enlarged due to that the separation of the inner housing 11 and the outer housing 12 and the integration of the cylinder 10 and sleeve 20.

Note that the specification relating to the above embodiment should be construed as an exemplary rather than as a limitative of the present invention, with many variations and modifications being readily attainable by a person of average skill in the art without departing from the spirit or scope thereof as defined by the appended claims and their legal equivalents.

I claim:

1. An automatic spray gun comprising:

a cylinder having an inner housing integrated with an outer housing by means of a plurality of ribs wherein two of the ribs on opposing circumferences have a screw hole in top;

a motor integrated with a turbine disposed inside the inner housing;

a sealing cap sealing off the inner housing having a central bore and a pair of slits in opposing peripheries engaged with the screw holed ribs;

an outer cap covering the outer housing having a plurality of air slots spacedly formed in a periphery and a pair of through holes symmetrically formed in opposing sides of a top engaged with the slits of the sealing cap and the screw hole of the ribs of the cylinder and fasten by a pair of screws;

a sleeve perpendicularly integrated with a lower periphery of the cylinder having an inverse L-shaped link on a top connected to a middle periphery of the cylinder, an axial tube on a top abutting the cylinder for suspending a Y-shaped pressing means thereform, a U-shaped plate on top, a hinder integrated with a lateral portion of the U-shaped and a handle bolt screwed into a lower portion of the Y-shaped pressing means biased by a small spring, a container cap integrated with an under side of the sleeve for covering a paint container with a hose disposed theretween, four anti-fouling pipes spacedly formed in front end, an air hole together with a liquid flowing canal in center and a plurality concaves in the front circumference thereof;

a nozzle having a swivel inner plate, a tubular head and a swivel cap wherein the swivel inner plate has a central air canal surrounded by a plurality of small air canals which are engageable with the anti-fouling pipes of the sleeve and a plurality of protrusions on periphery engageable with the concaves of the sleeve, the tubular head has an opening in rear end for insertion of a front end of a needle and a threaded front end to engage within the central air canal of the swivel inner plate, the swivel cap covers the swivel inner plate and the tubular head and rotatably secures to the front end of said sleeve and has a control hole for spraying atomized paint to a working pieces;

a tube and a hair switch disposed in an upper portion of the first half handle wherein tube is biased by an outer spring, an inner spring, biased the needle and touching means at inner end to touch a pair of metal tongues of the hair switch which actuates the motor to rotate;

a plurality of electric wires fixed into the first half handle for connecting the cuter electric power to the motor through the hair switch;

a second half handle assembled to the first half handle by a plurality of screws.

2. The automatic spray gun as recited in claim 1, wherein said seating cap is made of plastic, metal and/or hard sponge.

* * * * *